US007216524B1

(12) United States Patent
Brewer, Sr. et al.

(10) Patent No.: US 7,216,524 B1
(45) Date of Patent: May 15, 2007

(54) VEHICLE REPAIR APPARATUS

(76) Inventors: Clarence R. Brewer, Sr., P.O. Box 271, Central City, KY (US) 42330; Chad Michael Jarvis, P.O. Box 271, Central City, KY (US) 42330

( * ) Notice: Subject to any disclaimer, the term of this patent is extended or adjusted under 35 U.S.C. 154(b) by 269 days.

(21) Appl. No.: 10/828,132

(22) Filed: Apr. 20, 2004

Related U.S. Application Data

(60) Provisional application No. 60/464,262, filed on Apr. 21, 2003.

(51) Int. Cl.
*B21J 13/08* (2006.01)

(52) U.S. Cl. ..... 72/457; 72/705

(58) Field of Classification Search ..... 72/457, 72/705; 254/9 R, 9 B, 8 B
See application file for complete search history.

(56) References Cited

U.S. PATENT DOCUMENTS 4,151,737 A * 5/1979 Specktor ..... 72/457
4,660,405 A * 4/1987 Widegren et al. ..... 72/447
4,930,333 A * 6/1990 Marbury ..... 72/447
5,355,711 A * 10/1994 Chisum ..... 72/457
5,771,739 A * 6/1998 Hinson ..... 72/447
6,446,481 B1 * 9/2002 Ballard et al. ..... 72/446
6,464,205 B2 * 10/2002 Wanner ..... 254/122
6,701,770 B2 3/2004 McClellan et al. ..... 72/457
6,974,123 B2 * 12/2005 Latvys ..... 254/122

* cited by examiner

*Primary Examiner*—Ed Tolan
(74) *Attorney, Agent, or Firm*—George H. Morgan; Mark A. Manley

(57) ABSTRACT

A vehicle body repair apparatus comprises a platform with cross member retainers, unibody clamps, at least one pulling assembly, at least one movable cross member, a scissors lift, and a lifting assembly.

The lifting assembly comprises an actuator at an angle with respect to the platform, so a toggle action exists that enables the scissors lift to raise the platform from a minimal height position from a floor surface.

4 Claims, 19 Drawing Sheets

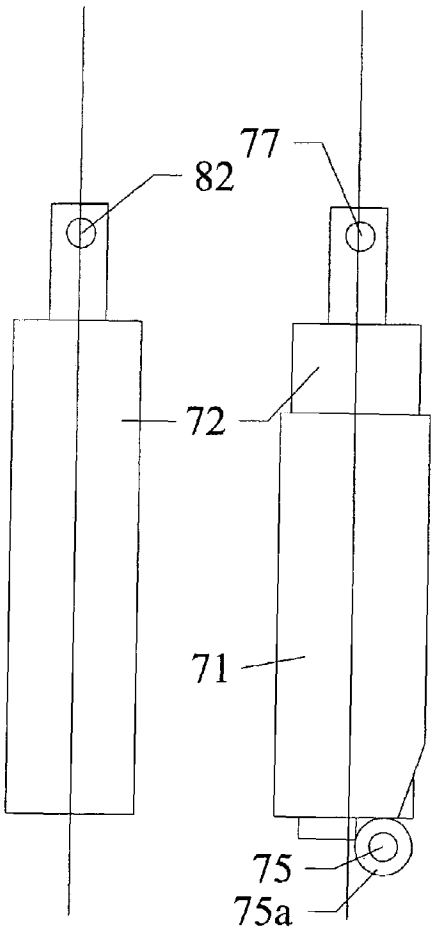
Fig. 9a
Fig. 9b
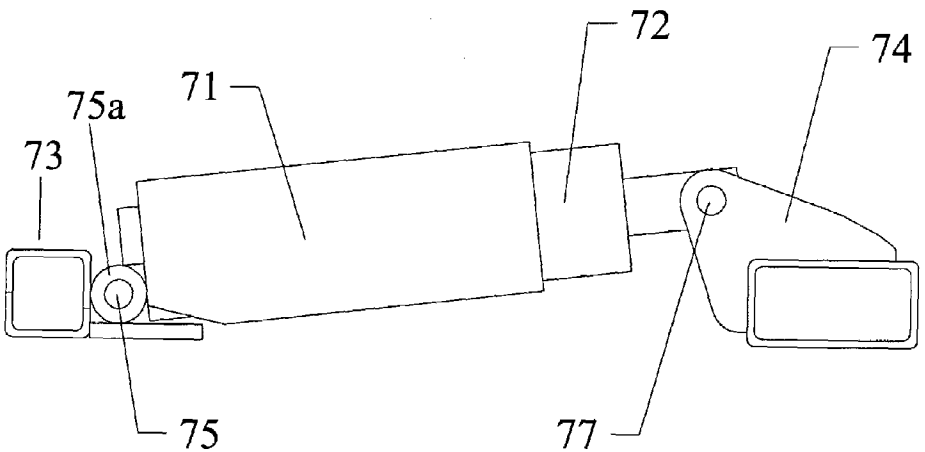
Fig. 9

VEHICLE REPAIR APPARATUS

CROSS REFERENCES TO RELATED APPLICATIONS

Provisional Application for Patent 60/464,262 of Apr. 21, 2003, with the same title, "Vehicle Repair Apparatus" which is hereby incorporated by reference. Applicants claim priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not applicable

BACKGROUND OF THE INVENTION

1. Field of the Invention

This invention relates to the repair of damage to a vehicle body after a collision.

2. Background Information

The collision repair industry is very large. Skilled auto body collision repair is a relatively skilled trade, and skilled people are in demand. While collision repair equipment is available, there is always room for improvement.

As will be seen from the subsequent description, the preferred embodiments of the present invention overcomes these and other shortcomings of existing vehicle body repair equipment.

SUMMARY OF THE INVENTION

The present invention in the preferred embodiment is a vehicle body repair apparatus comprising a platform with cross member retainers, unibody clamps, at least one pulling assembly, at least one movable cross member, a scissors lift, and a lifting assembly.

The pulling assembly comprises a pulling actuator with a ball end and a socket block. An alternate pulling assembly comprises alternate cylinder end attachments.

The lifting assembly comprises an actuator that sits in an actuator retainer that has offset ears, said actuator being mounted to a framed cross member in such a manner that the longitudinal axis of the actuator is at an angle with respect to the platform, so that a toggle action exists that enables the scissors lift to raise the platform from a minimal height position from a floor surface.

The lifting assembly further comprises a lifting arm with a rotating trigger, that serves as a locking mechanism to secure the scissors lift in position, without an operator having to manually insert pins, chains, or other safety locking means to secure the scissors lift in position.

BRIEF DESCRIPTION OF THE DRAWINGS

FIGS. 8, 9, 9A, and 9B illustrate lifting assembly details.

DESCRIPTION OF THE PREFERRED EMBODIMENTS

Figure 1:
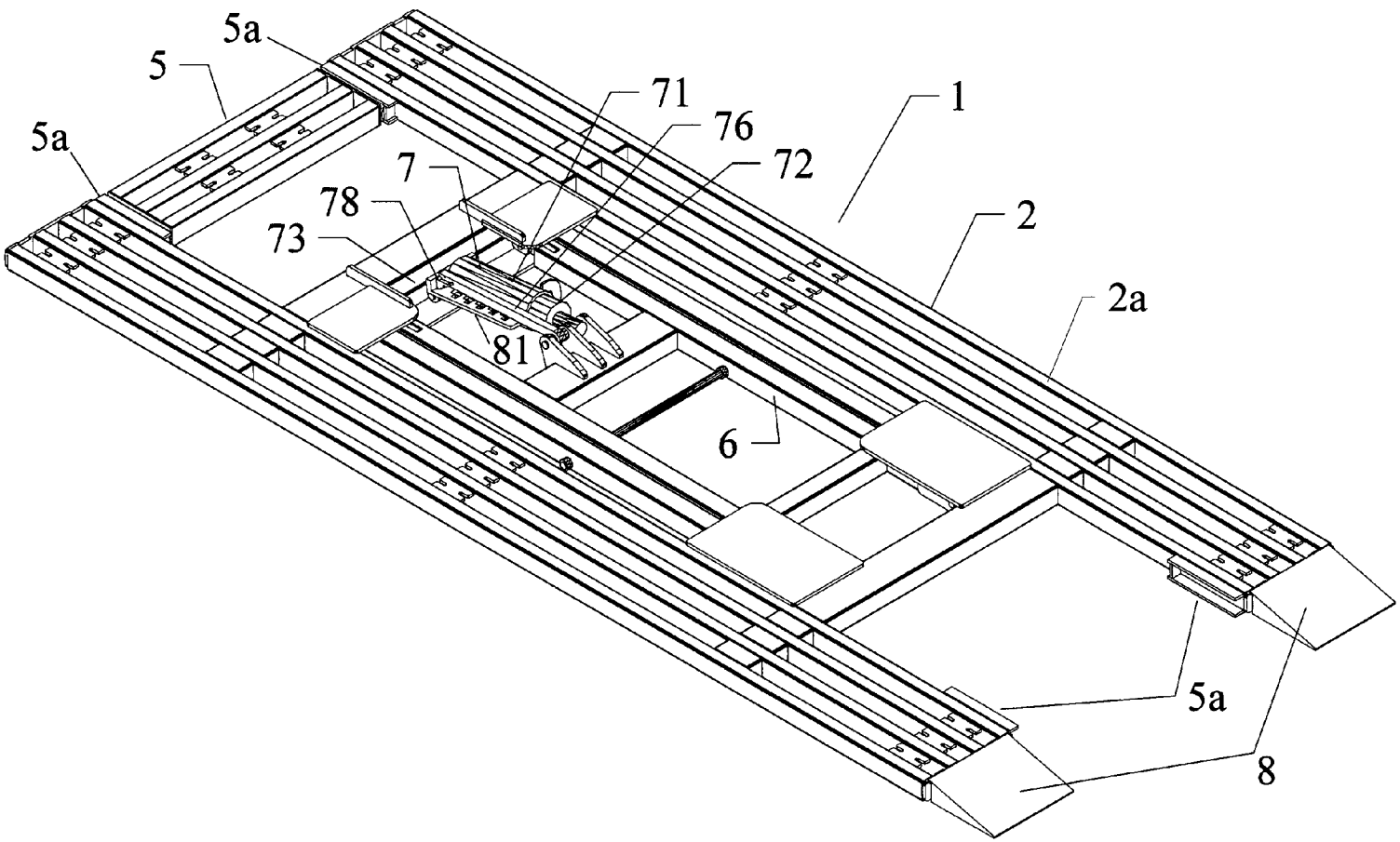
FIG. 1 illustrates the preferred embodiment of the present invention, a vehicle repair apparatus, prior to elevation.
Figure 2:
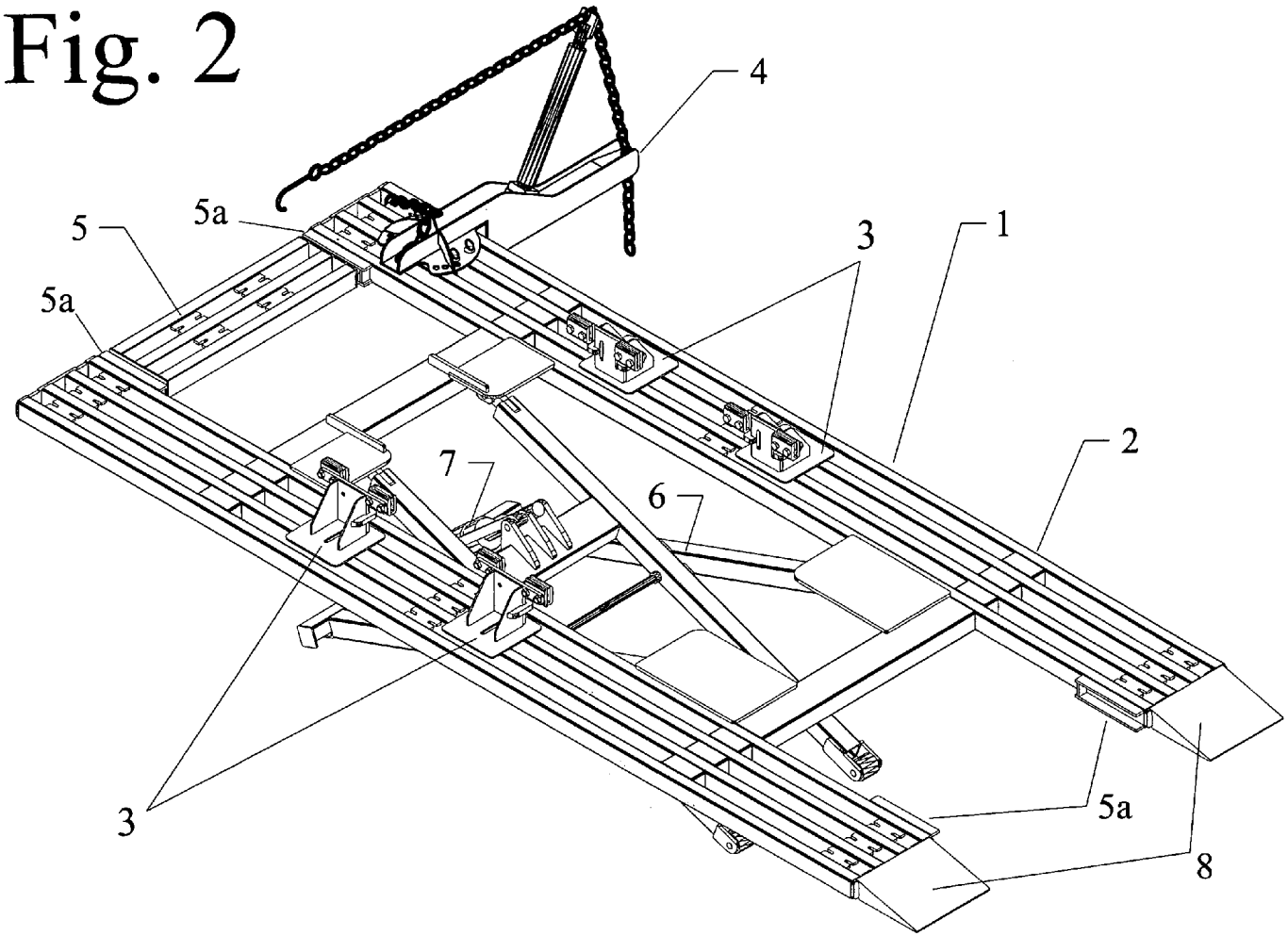
FIG. 2 illustrates the vehicle repair apparatus elevated, with various accessories in place.
Figure 3:
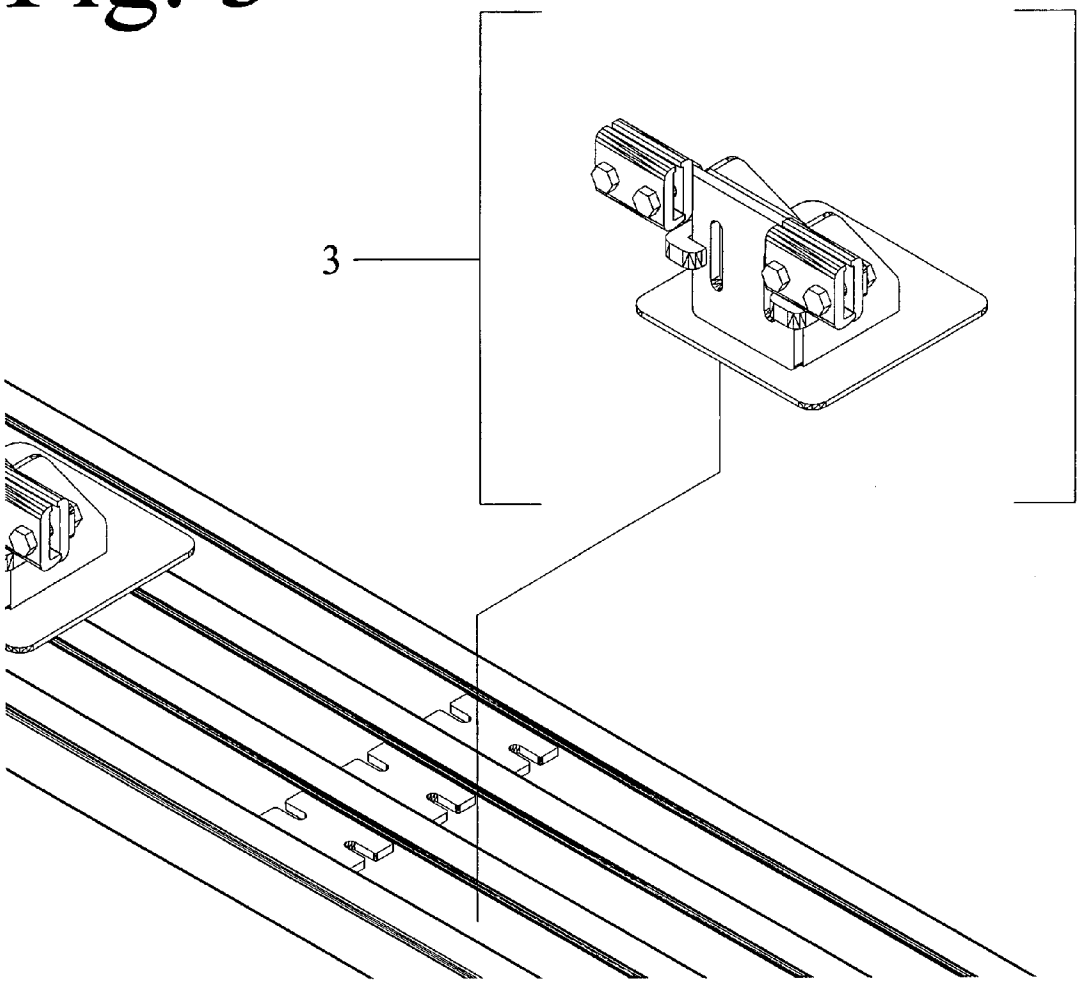
FIGS. 3 through 6 illustrate various accessory details.

Referring to FIGS. 1 and 2, the preferred embodiment of the present invention, a vehicle repair apparatus 1 comprises a platform 2 with cross member retainers 5*a* (Ref. also FIGS. 4 and 5), unibody clamps 3 (Ref. also FIG. 3), at least one pulling assembly 4, at least one cross member 5 (Ref. also 4 and 6), a scissors lift 6, and a lifting assembly 7.

Figure 4:
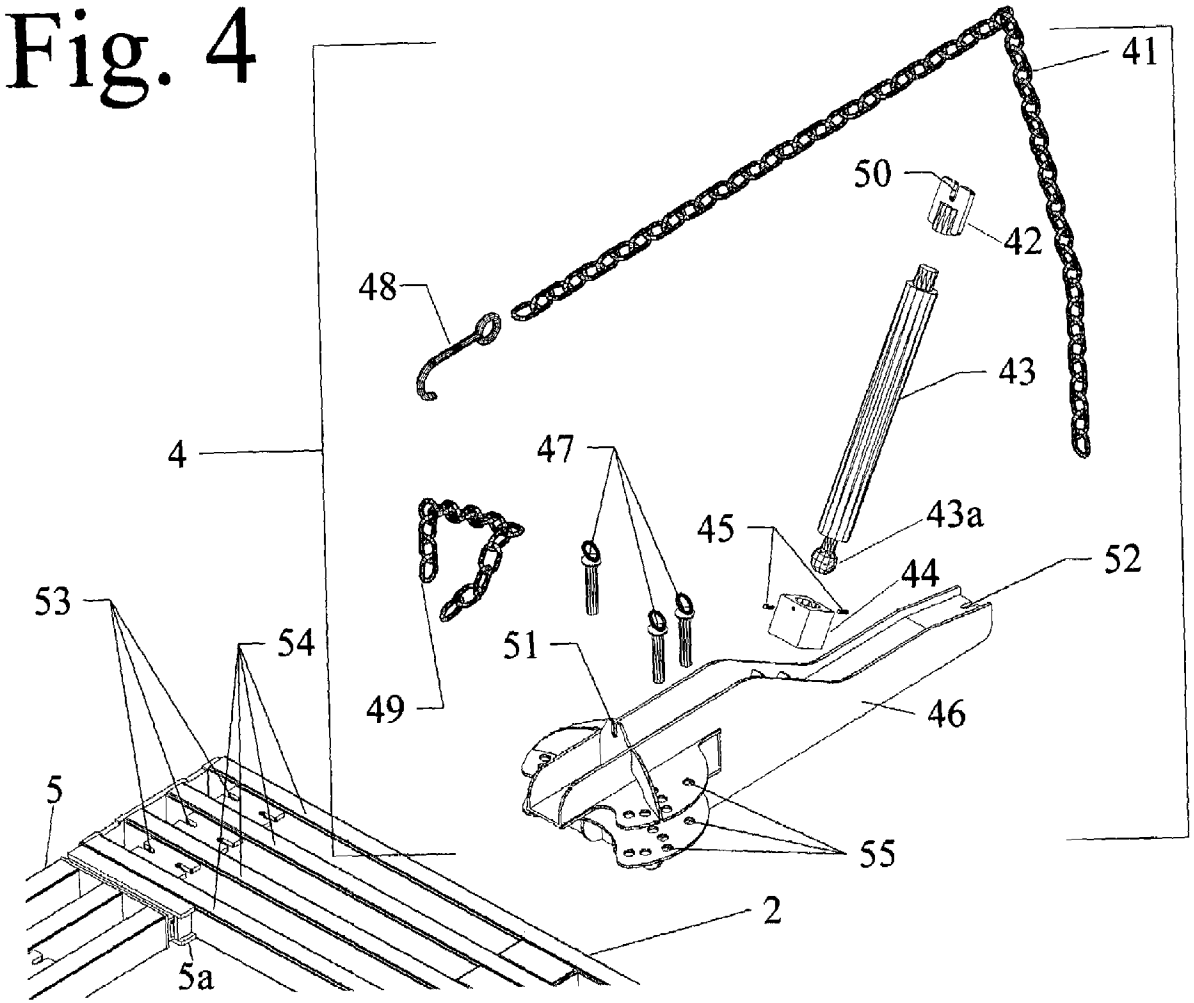
Figure 4A:
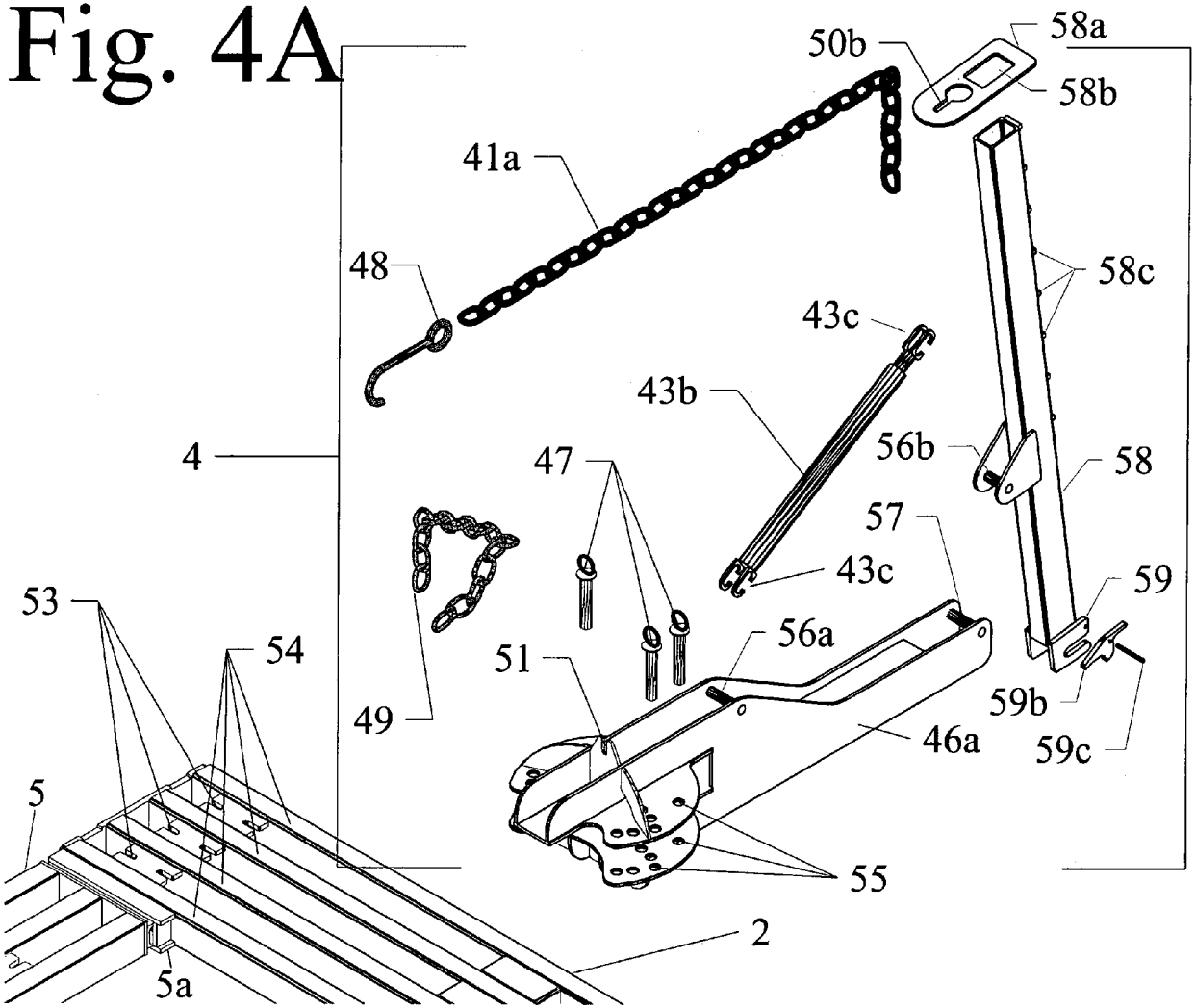
Figure 5:
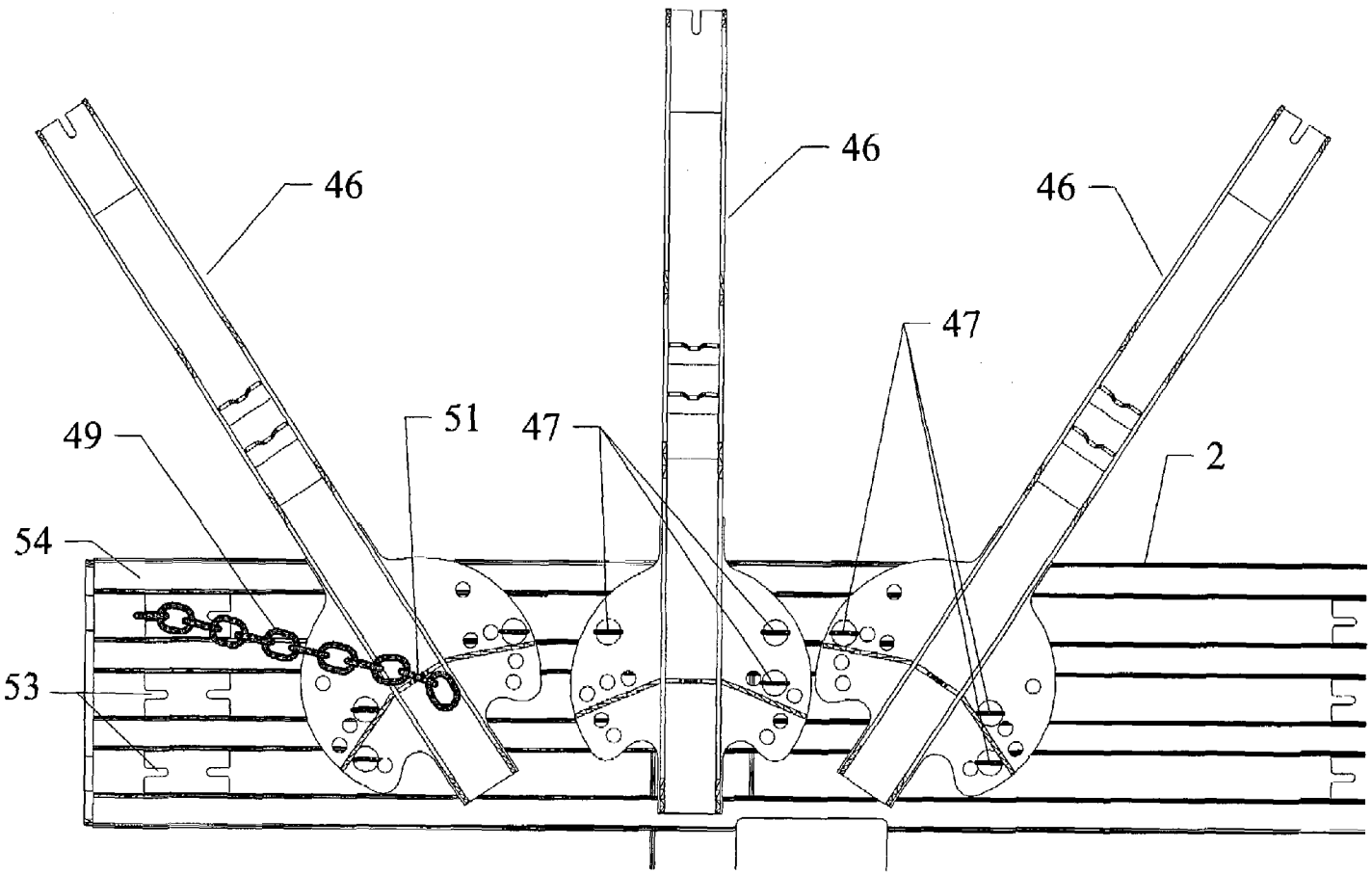

Referring to FIGS. 4, 4A, and 5, a pulling assembly 4 comprises a tension member 41 with a hook 48; a chain retainer 42 with a chain retainer slot 50; an actuator 43 with a ball end 43*a*; a socket block 44; ball retainer screws 45; a body 46 further a stabilizing chain retaining slot 51, a body chain retainer slot 52, and drift pin retaining apertures 55; drift pins 47, and a lateral restraint 49.

The body 46 is installed on the platform 2 with drift pins 47 dropped through the drift pin retraining appertures 55 and between the bars 54. With the drift pins 47 in place, the body 46 can be slid along bars 54 of the platform 2. For direct pulling of vehicle body parts (not shown), the body 46 of the pulling assembly 4 will stay in place. For angled pulls, the lateral restraint 49 fitted into said slots 51 and 52 serves to keep the body 46 in place. In the preferred embodiment of the present invention, the lateral restraint 49 is a steel chain.

In the preferred embodiment of the present invention, the actuator 43 is a fluid power actuator. With the tension member 41 attached to the body 46 via said slot 52; the hook 48 attached both to the tension member 41 and a vehicle part (not shown) to be pulled from a vehicle; the tension member 41 engaged in the chain retainer slot 50 of the chain retainer 42 attached to the actuator 43; and the ball end 43*a* of the actuator 43 seated in the socket block 44 which is seated in the body 46; actuating the actuator 43 puts tension on the tension member 41, resulting in a pulling force on the vehicle part. The ball end 43*a* plus the freedom of movement of the body 46 along the platform 2 adds considerable simplicity and ease of operation to the operation of a pulling assembly 4.

In the preferred embodiment of the present invention, the socket block 44 as well as the ball end 43*a* are of steel while the ball retainer screws 45 are a softer material, such as brass.

The cross member 5 is retained as a part of the platform 2 by means of the platform retainers 5*a*. This permits the cross member 5 be removable as required and easily installable as required elsewhere on the platform 2, as indicated by locations of the cross member retainers 5*a* in FIG. 1.

An alternate pulling assembly, 4*a* comprises an alternate tension member 41*a* with the hook 48; drift pins 47; the lateral restraint 57; an alternate actuator 43*b* comprising hook ends 43*c*; an alternate body 46*a* further comprising the stabilizing chain retaining slot 51, an anchor pin 56*a*, a body pin 57, and the drift pin retaining apertures 55; a post puller 58 comprising a pin engagement means 59, a lock pivot pin 59*c*, a pin lock 59*b*, a cylinder pin 56*b*, and locating projections 58*c*; and a chain retainer plate 58*a* comprising an aperture 58*b* and a chain retaining aperture 50*b*.

The alternate body 46*a* is installed on the frame 2 with drift pins 47 dropped through the drift pin retaining apertures 55 and between the bars 54. With the drift pins 47 in place, the alternate body 46*a* can be slid along bars 54 of the platform 2. For direct pulling of vehicle body parts (not shown), the alternate body 46*a* of the alternate pulling assembly 4*a* will stay in place. For angled pulls, the lateral restraint 49 fitted into said slots 51 and 53 serves to keep the alternate body 46*a* in place.

In the preferred embodiment of the present invention, the alternate actuator 43*b* is a fluid power actuator.

The alternate actuator 43*b* attached to the alternate body 46*a* by means of the first hook ends 43*c* of the the alternate actuator 43*b* hooked around the body pin 56*a* of the alternate body 46*a*.

The alternate actuator 43*b* is attached to the cylinder pin 56*b* of the post puller 58 by engagement of the second hook end 43*c* of the alternate actuator 43*b*.

The alternate tension member 41*a* is attached to the chain retainer plate 58*a* by insertion of said tension member 41*a* into the chain retaining aperture 50*b* of the chain retainer plate 58*a*. The retainer plate 58*a* is located in a desired on the post puller 58 adjacent to a locating projection 58*c* and then is held in position by a wedging (i.e. "camming") action against the post puller 58 by the force from the alternate tension member 41*a*.

The pin engagement means 59 of the post puller 58 engages the body pin 57 of the alternate body 46*a*. The post puller 58 is locked in place to the body pin 57 by means of the pin lock 59*b* that rotates into a locking position around the lock pin 59*c*.

As the alternate actuator 43*b* is extended, the post puller 58 is forced outward, placing the tension member 41*a* in tension, pulling a part (not shown) off of a vehicle (not shown) on the platform 2 of the vehicle repair apparatus 1.

The vehicle repair apparatus 1 lies flat on the floor, as indicated in FIG. 1. No foundation is required other than a level floor of sufficient capacity to carry the load of said apparatus 1 and a vehicle driven or moved onto the said apparatus 1.

Detachable ramps 8 facilitate moving a vehicle onto said apparatus 1.

Referring to FIGS. 1, 7, 8, 9, 9A, and 9B, the lifting assembly 7 comprises an actuator retainer 71, an actuator 72, an offset mounting cross member 73, a frame cross member 74, an actuator pivot rod 75, a locking arm 76, with a heel 76*a*, a cam 76*b*, and a catch 79, a locking arm pivot rod 77, a trigger 78 with a nose 78*a*, and a trigger pivot pin 80.

The actuator 72 is seated in the actuator retainer 71. The actuator 72 as well as the locking arm 76 are pivotly connected to the frame cross member 74 by means of the locking arm pivot rod 77.

The actuator retainer 71 comprises a lock plate 81.

The actuator retainer 71 with the lock plate 81 is pivotly connected to the offset cross mounting member 73, The offset cross mounting member 73 is affixed to the proximate arms 64 of the scissors lift 6 while the frame cross member 74 is affixed to the distal arms 62 of the scissors lift 6.

The proximate arms 64 and the distal arms 62 rotate with respect to each other with a metal shaft 65 connecting said arms 64 to 62.

Said arms 64 comprise metal rollers 63 which engage the platform 2.

Said arms 62 comprise rollers 61 which roll along a floor surface and attachment means 66 which attach the platform 2 to the scissors lift 6.

The vehicle repair apparatus 1 rests on a garage floor surface as opposed to existing repair apparatuses that require below floor surface installation. This is an advantage of the present invention.

The platform 2 is attached to, and rests on, the scissors lift 2 and is raised and lowered by the scissors lift 2.

With said apparatus 1 flat, at rest, as shown in FIG. 1, the mounting of the actuator retainer 71, with the offset ears 75*a*, to the frame cross member 74, in such a manner that the longitudinal axis of the actuator 72, which is seated in the actuator retainer 71, is at an angle with respect to the platform 2, a toggle action exists enables the actuator 72 to raise the platform. If the actuator 72's longitudinal axis was in line with the platform 2, the scissors lift 6 could not raise the platform 2 from the at rest position.

Having a minimal height of the platform 2 with respect to a floor avoids installing portions of a vehicle repair apparatus below a floor level, as compared to many service station and garage ramps that typically involve installing a lift cylinder below a garage floor level.

Referring to FIGS. 8, 10, 10A, 11, 12, 13, 14, 15, 16*j*, and 17, the locking arm 76 freely pivots about the locking arm pivot rod 77. The trigger 78 rotates with respect to the locking arm 76, about the trigger pivot pin 80.

The lock plate 81 comprises clearances 81*a*. Each clearance 81*a* comprises a locking arm clearance 81*c* and a trigger clearance 81*b*.

The catch 79, attached to the locking arm 76, restricts the rotation of the trigger 78.

Figure 10:
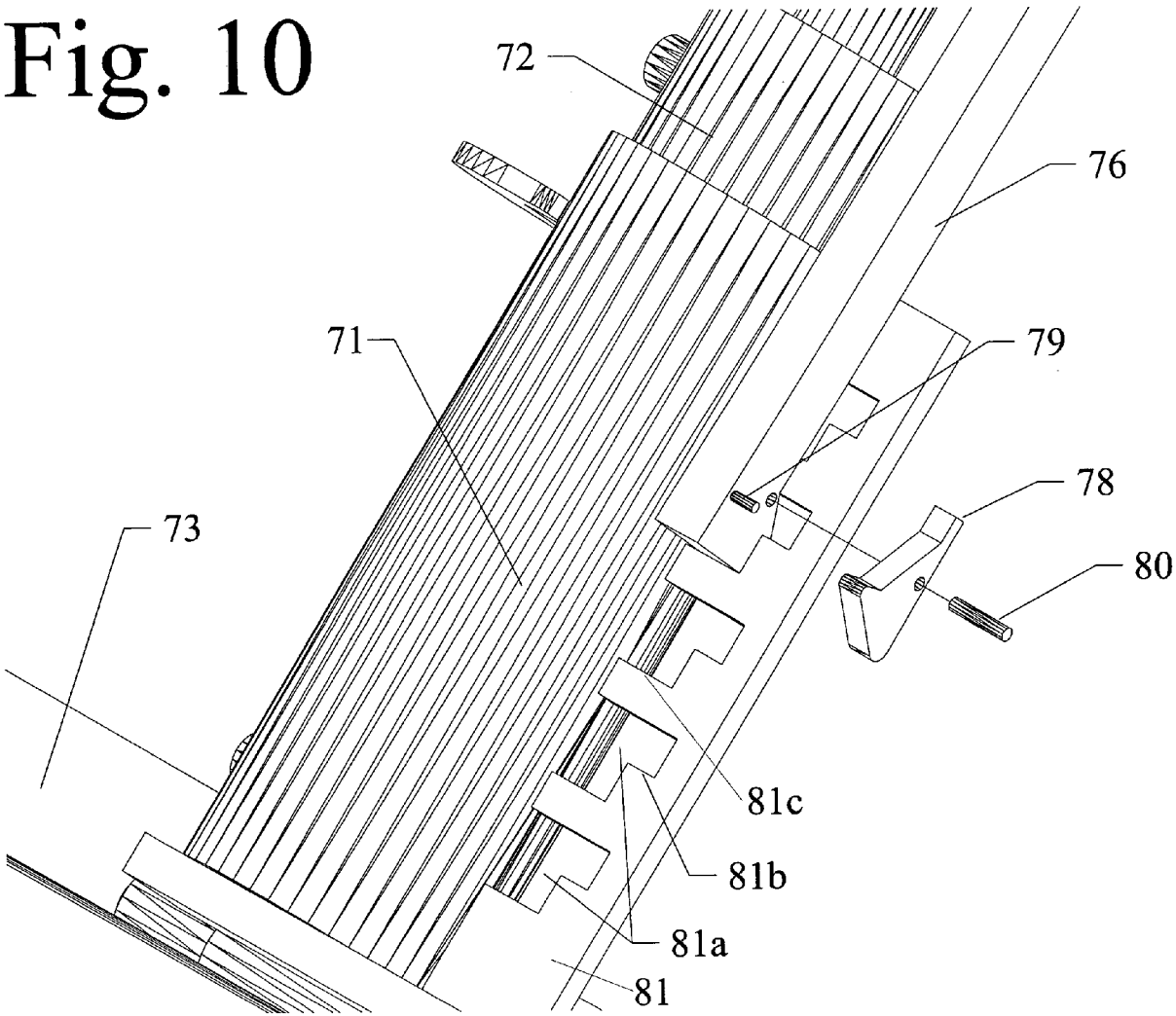
FIGS. 10 through 17 illustrate operation of a safety lock and trigger.
Figure 10A:
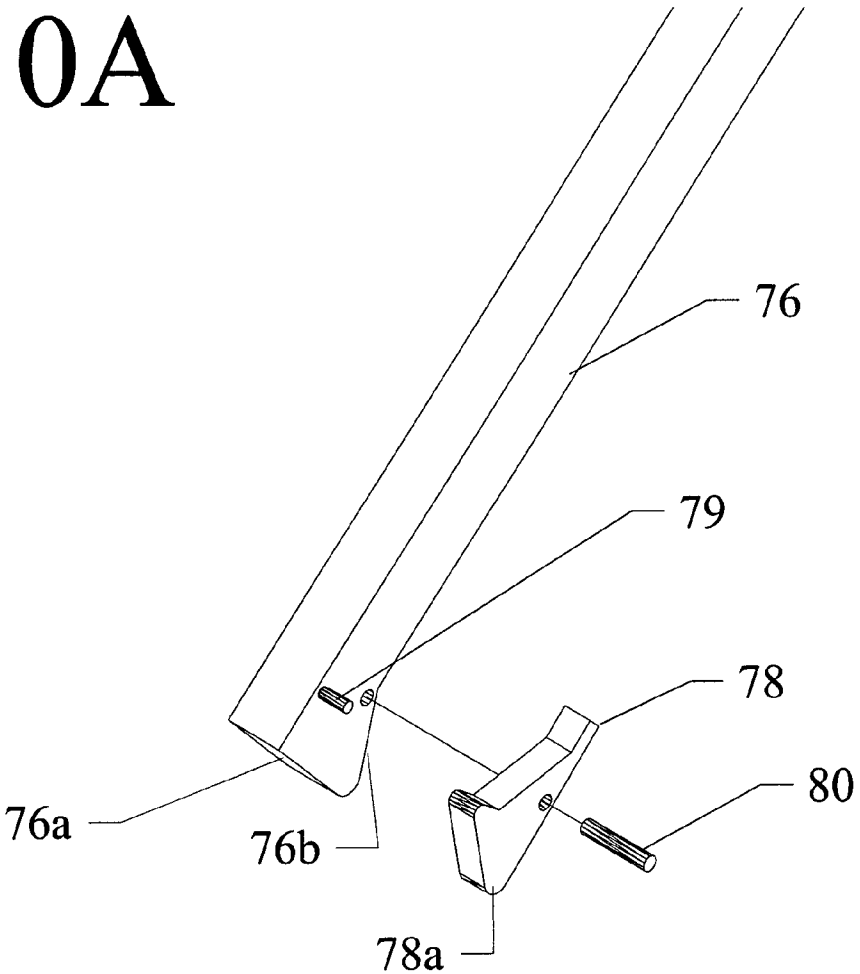

FIG. 10 shows the locking arm 76 held in place, by gravity, in one of the locking arm clearances 81*b*, serving as a mechanical lock, locking the scissors lift 6 in a given position. The trigger 78 is shown in a proper orientation with respect to the locking arm 76, but as an exploded view for clarity. Refer also to FIG. 10A.

Figure 11:
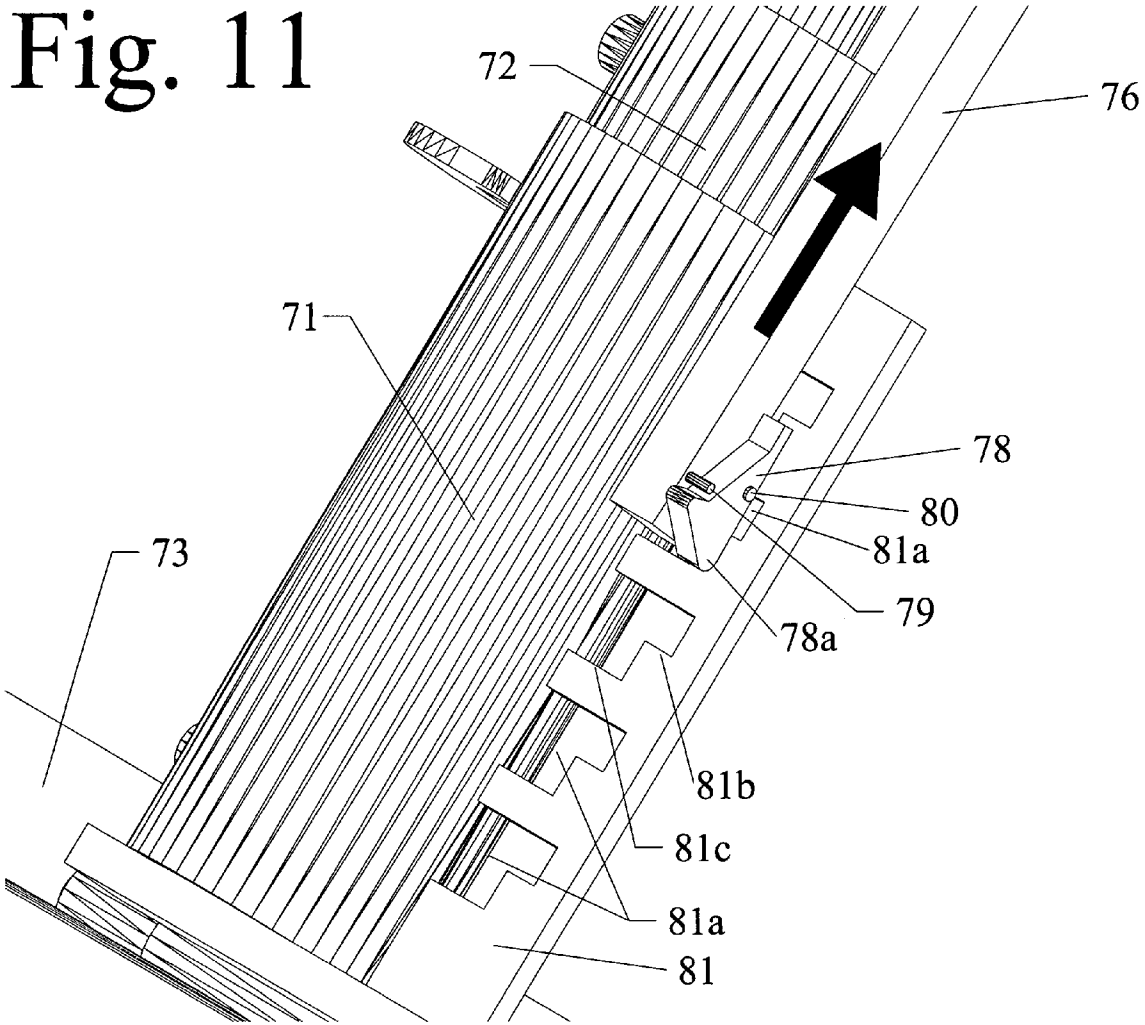

To raise the scissors lift 6, an operator extends the actuator 72, and the locking arm 76, moving in a forward direction as indicated in the FIG. 11, is dragged along the lock plate 81. The cam 76*b*, by engaging the lock plate 81, causes the locking arm 76 to climb out of the locking arm clearance 81*c*.

Figure 12:
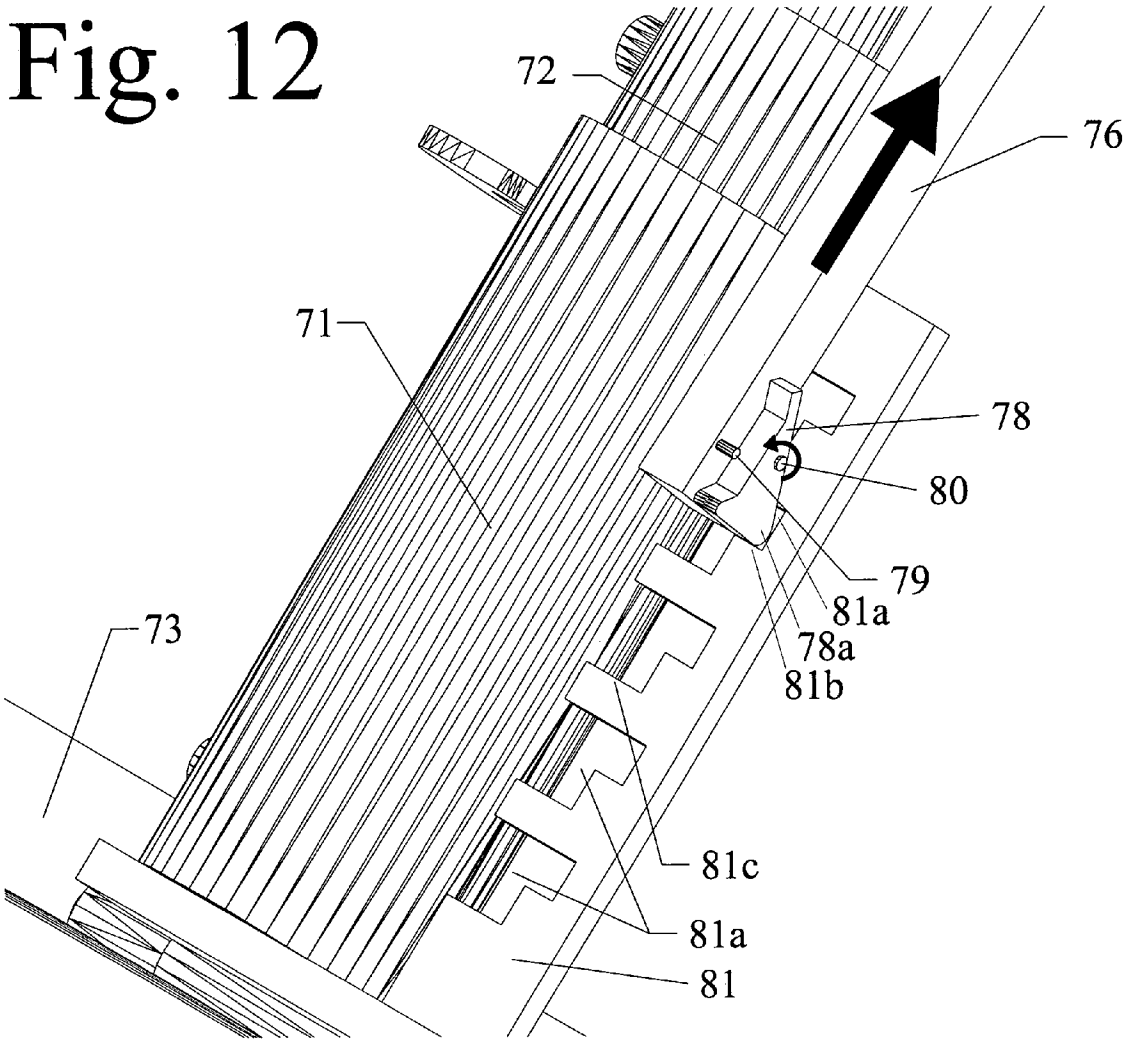

As the locking arm 76 moves forward, as indicated by the arrow in FIG. 12, the nose 78*a* of the trigger 78 falls into the trigger clearance 81*a*, rotating in the direction indicated by the smaller arrow.

An operator can continue to raise the scissors lift 6, or the operator can lower the scissors lift by retracting the actuator 72.

Figure 13:
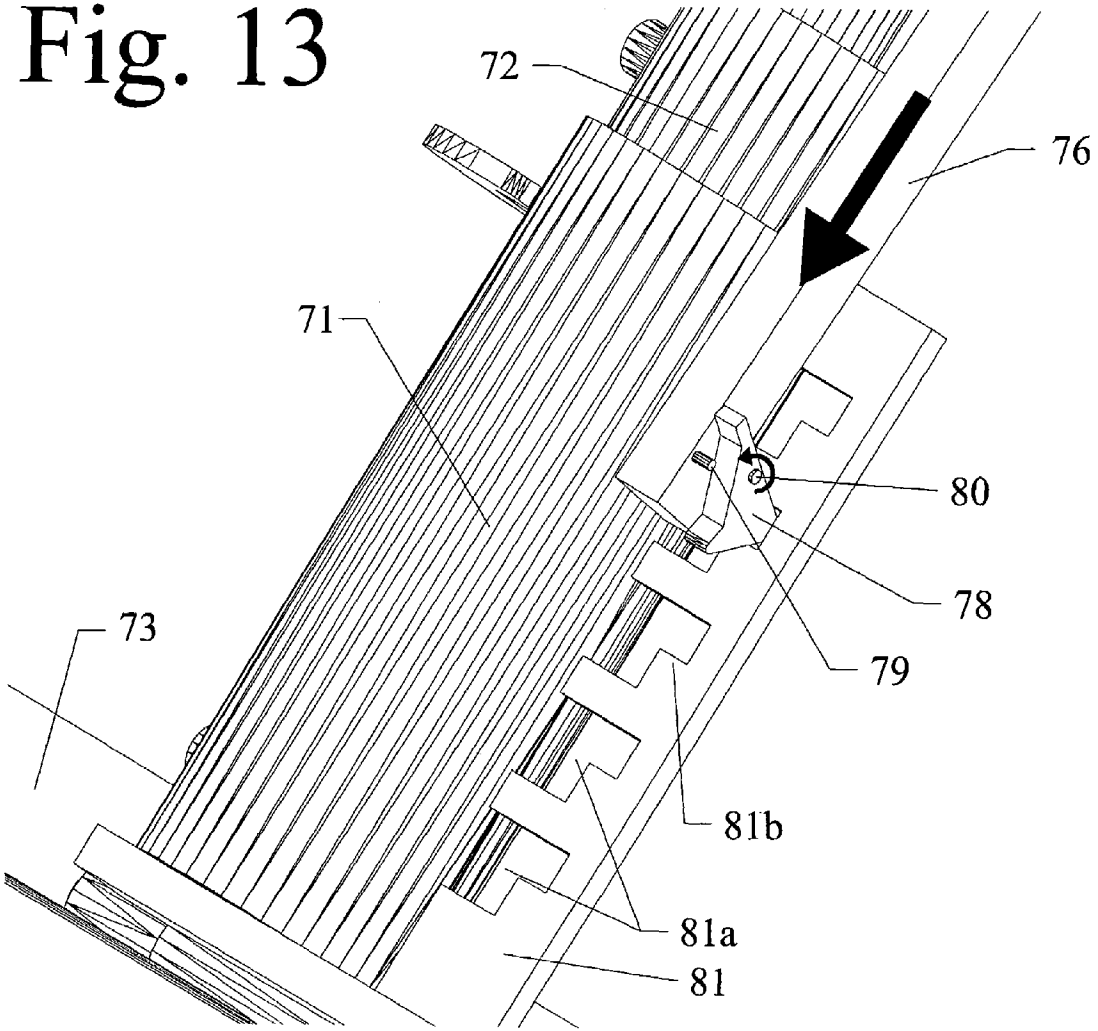

FIG. 13 shows the actuator 72 in retraction, with the lifting arm 76 moving in reverse, as indicated by the directional arrow, with the trigger 78 rotating in the direction indicated by the smaller arrow, lifting the heel 76*a* of the lifting arm 76 above the plate 81 so that the heel 76*a* does not engage the plate 81.

Figure 14:
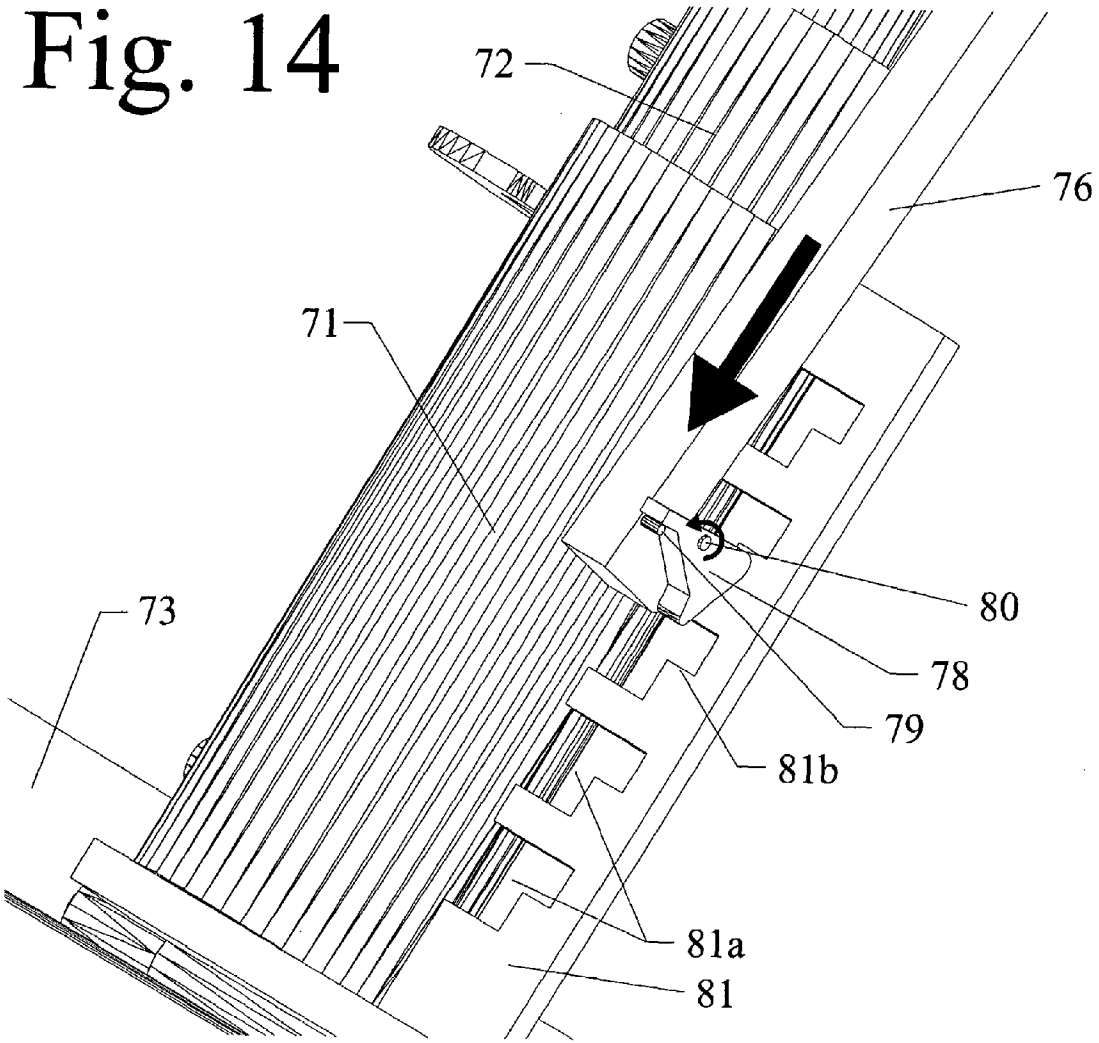

FIG. 14 shows the actuator 72 retracting further, with the trigger 78 rotated counter clockwise until stopped by the catch 79.

With the trigger 78 rotated counter clockwise until stopped by the catch 79, the trigger 78 holds the heel 76*a* of the lifting arm 76 above the plate 81 so that the heel 76*a* does not engage the plate 81 while the actuator 72 continues retracting.

If a desired position is below the position indicated in FIG. 14, an operator merely keeps retracting the actuator 72 until the lifting arm 76 is below a desired clearance 81A then extends the actuator 72 until the lifting arm 76 falls into a desired clearance 81A. Then the operator releases pressure extending the actuator 72 and the weight of the scissors lift 6 acts to hold the lifting arm 76 jammed against the plate 81, as shown in FIG. 10.

Figure 15:
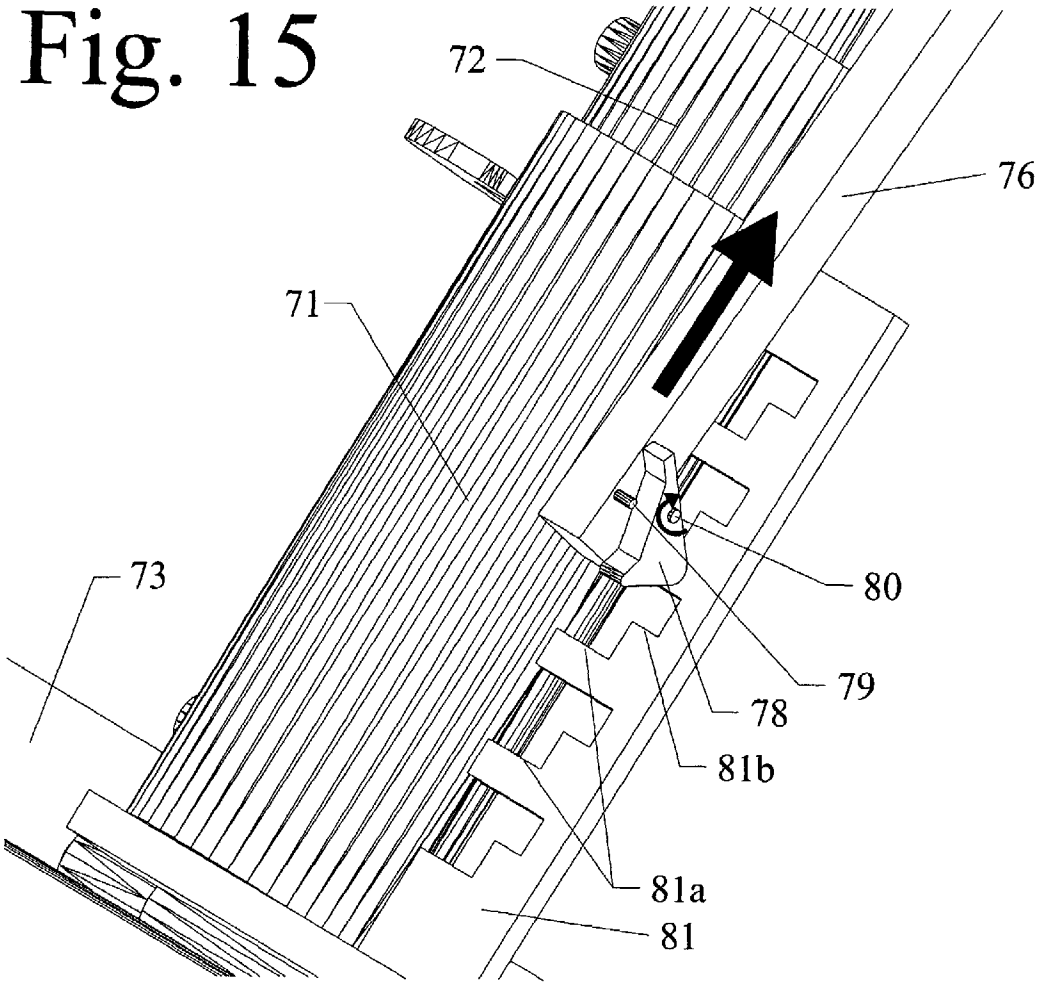
Figure 16:
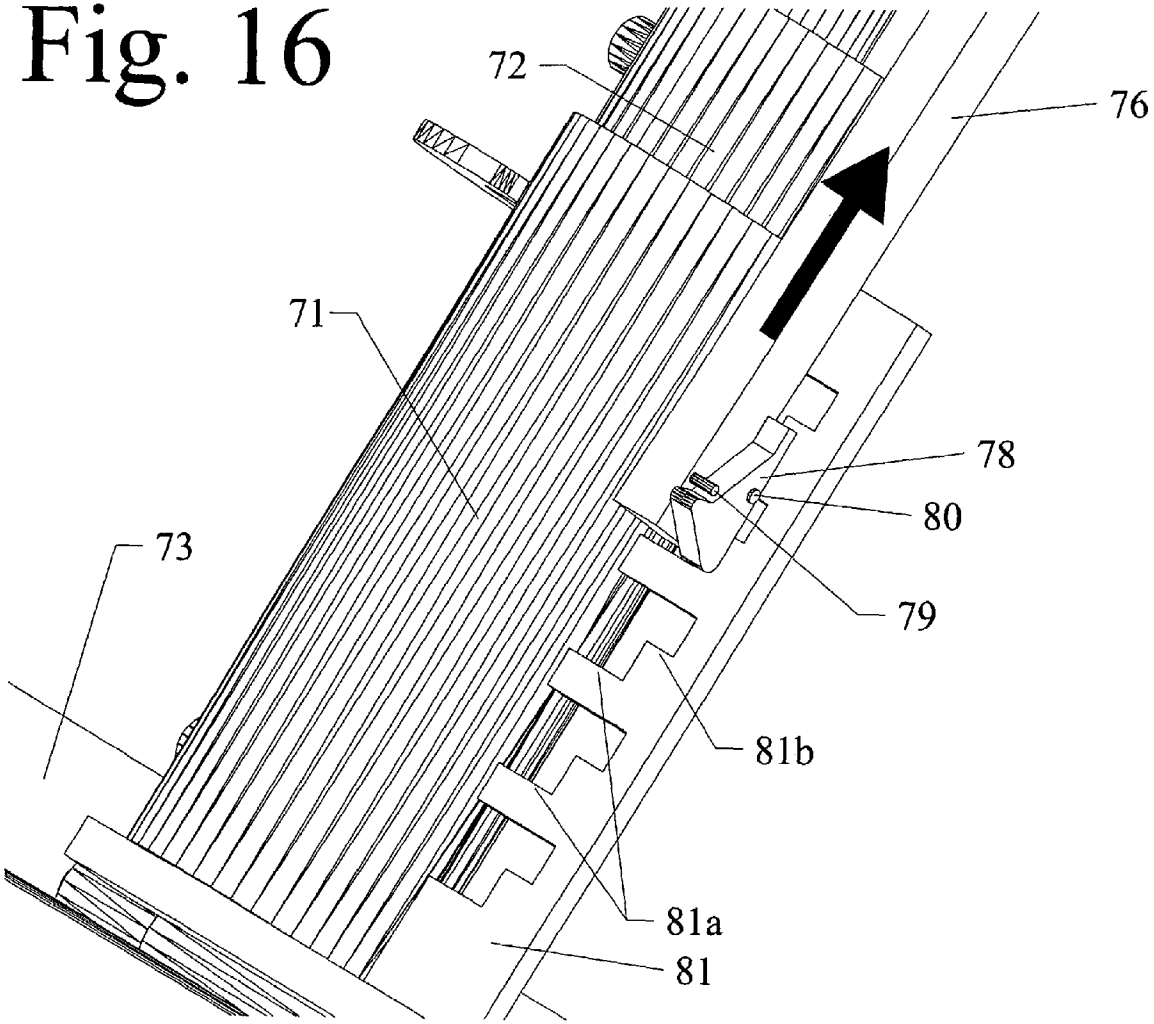
Figure 17:
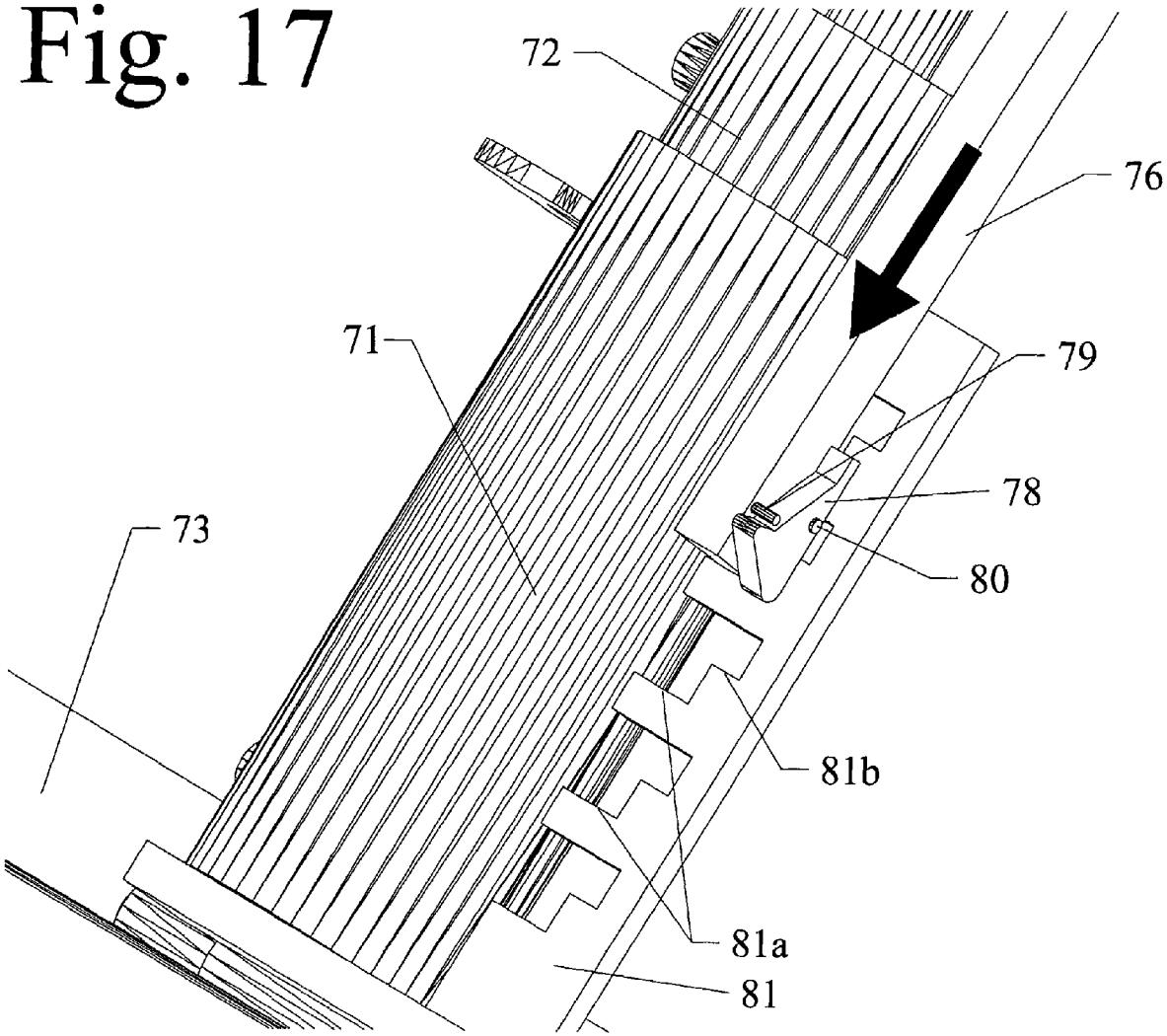

If a desired position is above the position indicated in FIG. 14, the operator merely extends the actuator 72 as indicated in FIGS. 15, and 16, and the lifting arm 76 falls into each successive clearance 81A. When a desired clearance 81A is reached, the operator merely stops extending the actuator 72, and the lifting arm falls into place, as indicated in FIG. 17.

In operation a vehicle, not shown, can be pulled or driven onto the movable ramps 8 and onto the platform 2. Movable ramps 8 can be positioned at either end of the platform 2 to accommodate any work flow direction for moving vehicles onto and off the platform 2. The tires of the vehicle can rest on the bars 54. Once the vehicle is on the platform 2, the platform 2 can be raised from a nearly flat orientation of the platform 2 shown in FIG. 1 to a plurality of raised positions such as the raised position shown in FIG. 2. Generally the platform 2 is just a few inches high when in the flat position as shown in FIG. 1, which allows the platform 2 to be used to park a vehicle even when it does not need to be lifted. The longitudinal axis 82 of the actuator 72 is at an angle with respect to the platform 2, so that a toggle action exists that enables the scissors lift to raise the platform 2 from a minimal height flat position from a floor surface. In the minimal height position of the lift apparatus, no portion of the apparatus has a height greater than the platform upper surface 2*a*, see FIG. 1. The tops of bars 54 form the substantially planar platform upper surface 2*a* that the vehicle sits on and doubles as the surface where the pulling assembly 4 and vehicle hold downs such as unibody clamps 3 are attached. The platform 2 can be raised to a working height by lift assembly 7, typically a maximum travel of the lift assembly 7 might raise the platform 2 to an ergonomic work height in the range of 48–54 inches. Once raised to a lift position as shown in FIG. 2, the vehicle can be inspected. As shown in FIG. 12, as the actuator 72 lifts the platform 2, the heel 76*a* can drop into each successive opening 81*a*, providing an automatic mechanical height lock. When a desired height is reached deactivating the actuator 72 allows the weight of the vehicle and platform 2 to come to rest on the heel 76*a* in the opening 81*a*. This automatically, mechanically locks the vehicle at a desired height without an operator having to manually insert a safety lock and without the need for an additional step and without the need of expensive or complicated power locks.

Figure 6:
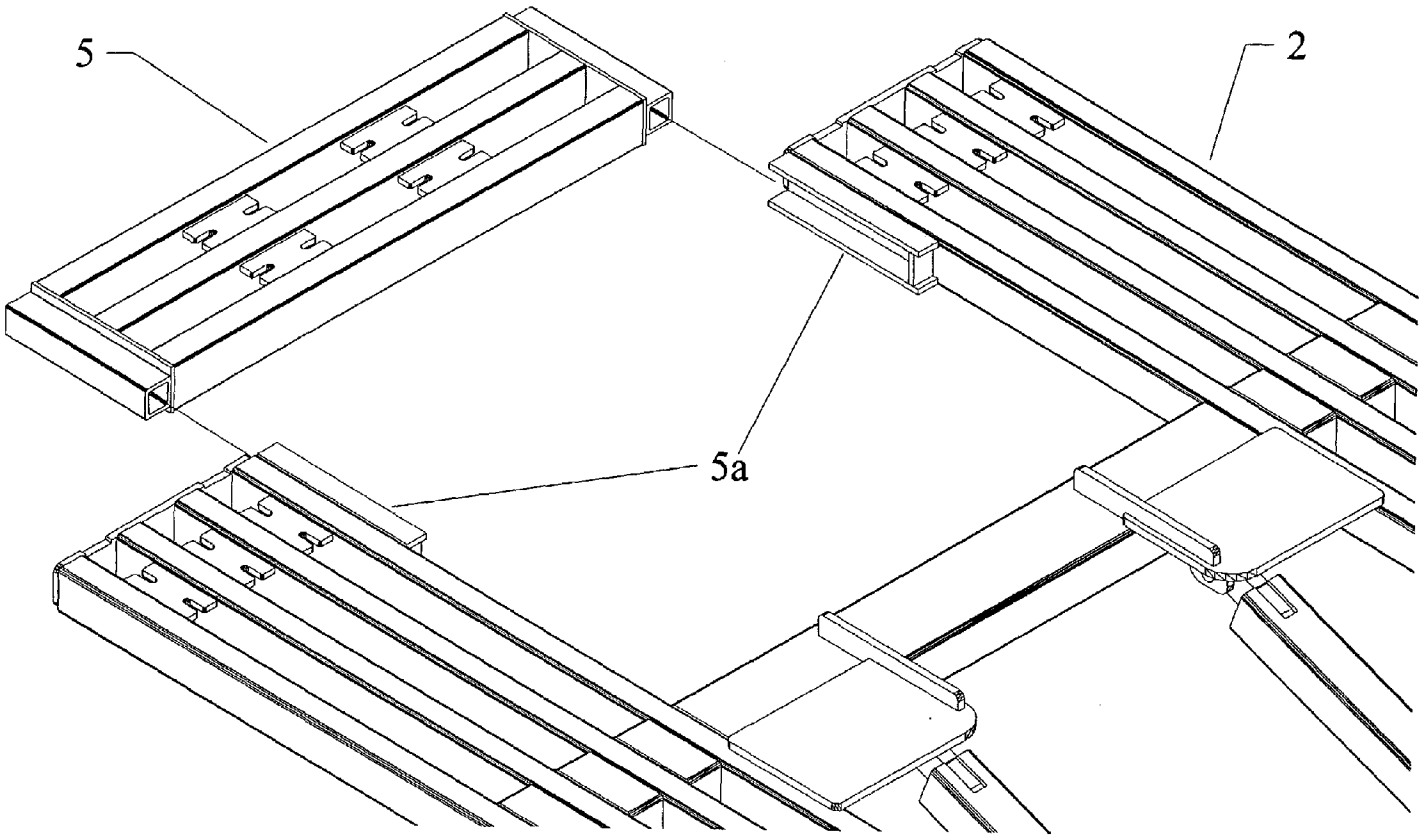
Figure 7:
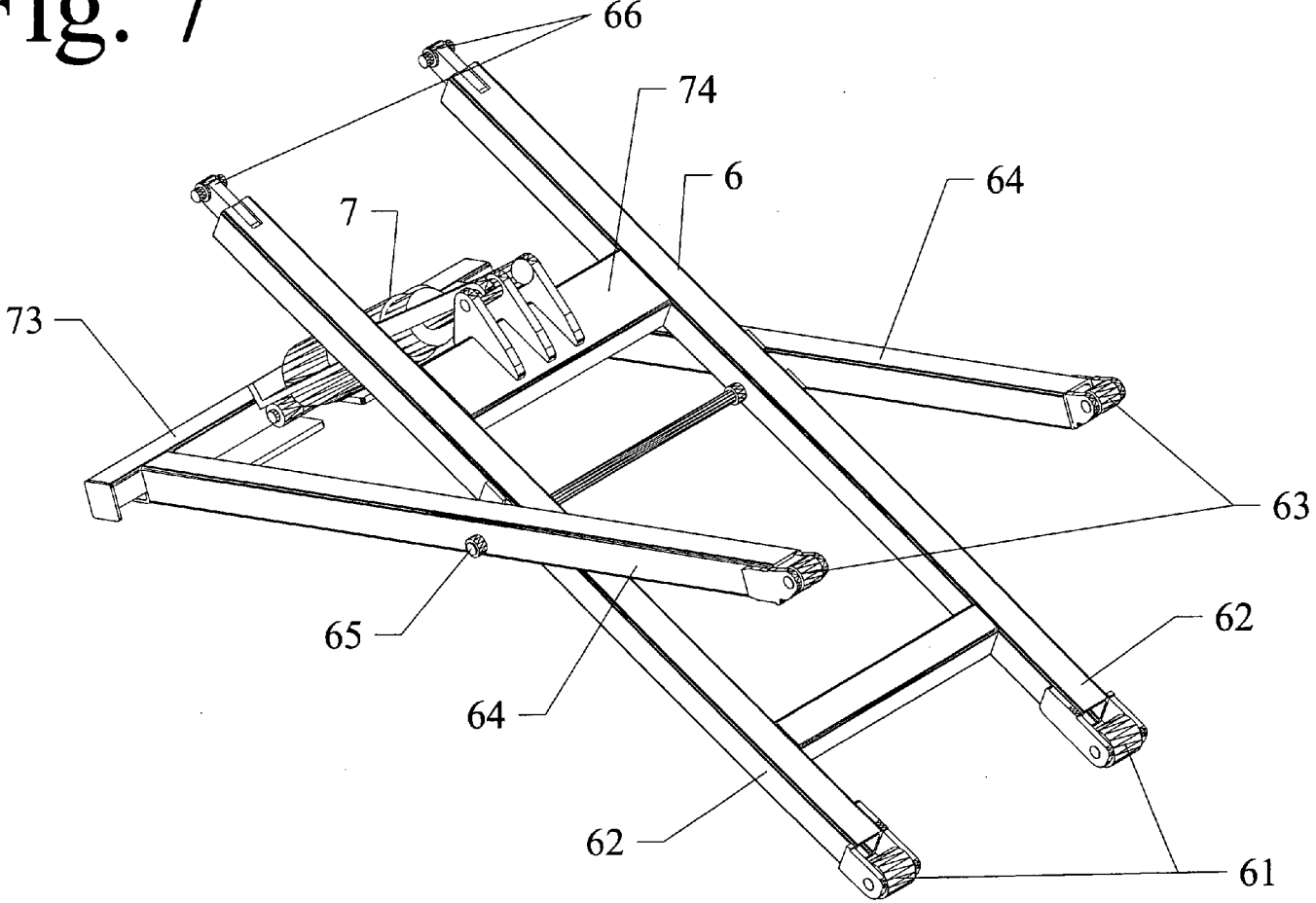
FIG. 7 illustrates a scissor lift.
Figure 8:
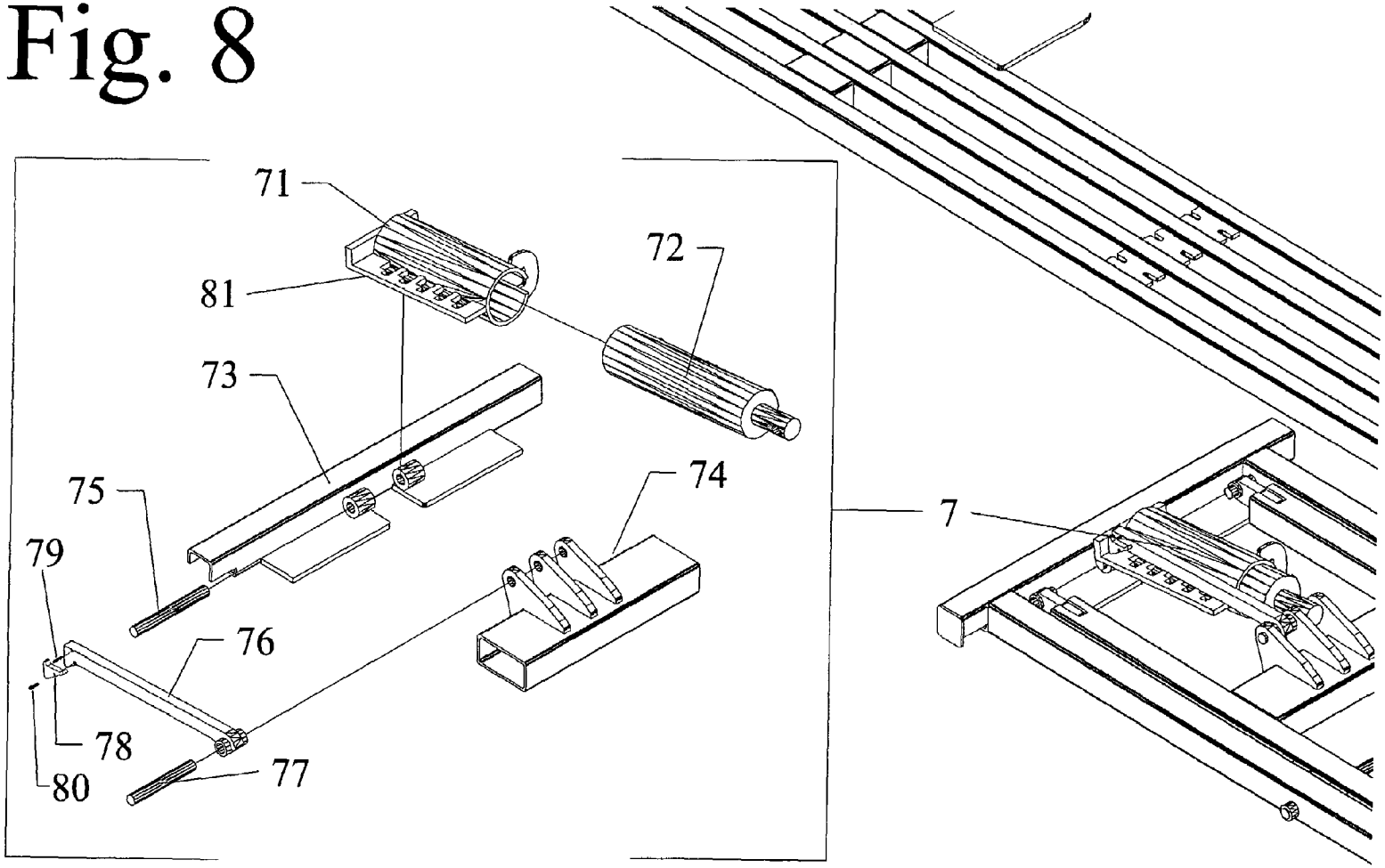

As shown in FIG. 6, cross member 5 can be slid out of the cross member retainer 5*a* to provide access under the raised vehicle. Once raised pulling assembly 4, unibody clamp 3 and chain lateral restraint 49 can be positioned on the platform 2. Though only a single chain lateral restraint 49 is shown it will be understood that a number of chain lateral restraints 49 of any length can be used as needed on the platform 2. The pulling assembly body 46 fits over the bars 54 and drift pins 47 can be placed through apertures 55 and the drift pins 47 pass through spaces between the bars 54. The drift pins 47 mount the body 46 to the bars 54 but can allow for the body to slide somewhat along the length of bars 54 to allow for positioning of the body 46. A chain lateral restraint 49 can be used to hold the body 46 in place by slipping a link of chain lateral restraint 49 through slots 51 and 53 as shown in FIG. 5, however in many applications the chain lateral restraint 49 may not be needed. The chain lateral restraint 49 would typically not be needed, for example, when the body 46 or pull direction is perpendicular to the bars 54. The body 46 can be positioned for a pull in the corner of the platform 2 or where the body 46 would be sitting on top of one of the cross member retainer 5*a*. The bars 54 in the platform 2 and those in the movable cross members 5 form a track around the vehicle and platform 2 such that said pulling assembly 4 can be positioned at any point, with infinite possible adjustment, on the perimeter surrounding said platform 2. FIG. 5 shows 3 of the possible points where the body 46 could be located. In addition to being positioned at any point on the bars 54 around the platform 2, the pulling assembly 4 can be positioned at a variety of angles relative to the bars 54. As shown in FIG. 5, depending on which aperture 55 the drift pin 47 is dropped through and depending on which space between bars 54 the drift pin 47 passes through. As can be seen a plurality of aperture patterns and bar 54 arrangements are possible.

In addition to being positioned at any location and angle around the platform 2, the pulling assembly 4 can include a post puller 58 that includes a variety of height adjustments 58*c* such that the hook 48 can be applied to any position and pulled at any angle in the volume of space above and around platform 2. In order to pull, the vehicle must be held in place. Unibody clamps 3 can grasp the unibody weld seam present along the rocker panel of most vehicles. The unibody clamps 3 can include bolt tightened jaws and slotted height adjustment as well as slots and apertures to accept drift pins 47 and chain lateral retainers 49 as needed.

The vehicle can also be held by chain lateral restraints 49. Links of chain lateral restraint 49 can be placed in one or more slots 53 and the chain lateral restraint 49 wrapped around a portion of the vehicle. The chain lateral restraint 49 would typically be placed on the platform 2 opposite a pull applied by pull assembly 4. Though movable, cross member 5 can support either pulling assembly 4 or chain lateral restraint 49 when installed. Though shown with a single pull assembly 4 it will be understood that several pull assemblies 4 could be used at once.

Once work is completed on a vehicle the platform 2 can be lowered under the control of lift assembly 7.

Although the description above contains many specificities, these should not be construed as limiting the scope of the invention but as merely providing illustrations of some of the presently preferred embodiments of this invention.

It will be obvious to those skilled in the art that modifications may be made to the embodiments described above without departing from the scope of the present invention. Thus the scope of the invention should be determined by the appended claims in the formal application and their legal equivalents, rather than by the examples given.

Although the description above contains many specificities, these should not be construed as limiting the scope of the invention but as merely providing illustrations of some of the presently preferred embodiments of this invention.

It will be obvious to those skilled in the art that modifications may be made to the embodiments described above without departing from the scope of the present invention. Thus the scope of the invention should be determined by the appended claims in the formal application and their legal equivalents, rather than by the examples given.

We claim:

1. A vehicle repair apparatus comprising:

a) a platform forming a work surface with cross member retainers;

b) at least one pulling assembly;

c) at least one movable cross member;

d) a scissors lift; and e) a lifting assembly;

wherein the at least one movable cross member is retained on the platform as required, is removable during platform use, and can be installed with said cross member retainers on the platform as required to move a portion of said work surface;

wherein the at least one pulling assembly is attachable to the platform;

wherein the platform is attached to, supported by, and raised and lowered by the scissors lift;

wherein the lifting assembly comprises an actuator, a longitudinal axis of the actuator is at an angle with respect to the platform, so that a toggle action exists that enables the scissors lift to raise the platform from a minimal height position from a floor surface.

2. The vehicle repair apparatus of claim 1 wherein the lifting assembly further comprises a lifting arm with rotating trigger that serves as a locking mechanism to secure the scissors lift in position, without an operator having to manually insert pins, chains or other safety locking means to secure the scissors lift in position and wherein said actuator sits in an actuator retainer that has offset ears.

3. The vehicle repair apparatus of claim 2 wherein the at least one pulling assembly comprises:

a) a tension member with a hook;

b) a chain retainer with a chain retainer slot;

c) an actuator with a ball end;

d) drift pins;

e) a socket block;

f) ball retainer screws;

g) a body further comprising: a stabilizer chain slot, a body chain retainer slot, and drift pin retaining apertures;

h) drift pin retaining apertures; and i) a lateral restraint;

wherein the body is installed on the platform with the drift pins dropped through the drift pin retaining apertures;

wherein with the drift pins in place, the body can be slid along the platform; wherein for angled pulls, the lateral restraint serves to keep the body in place;

wherein when the tension member is attached to the body chain retainer slot of the body at one end; the other end of the tension member attached to the hook which is attached to a vehicle part; the tension member engaged in the chain retainer slot of the chain retainer attached to the actuator; and the ball end of the actuator seated in the socket block which is seated in the body, actuating the actuator puts tension on the tension member, resulting in a pulling force on the vehicle part and wherein said rotating trigger travels with the movement of said actuator and automatically cooperates with a fixed opening to hold said platform against movement even when said actuator is deactivated.

4. The vehicle repair apparatus of claim 1 wherein the at least one pulling assembly comprises:

a) a tension member with hooks;

b) drift pins;

c) a lateral restraint;

d) an actuator comprising hook ends;

e) a body comprising: a chain retaining slot, an anchor pin, a body pin, and drift pin retaining apertures;

f) a post puller comprising: pin engagement means; a lock pivot pin, a pin lock, a cylinder pin, and locating projections; and g) a chain retaining plate comprising an aperture and a chain retaining aperture;

wherein the body is installed on the frame with drift pins dropped through the drift pin retaining apertures;

wherein with the drift pins in place, the body can be slid along the platform;

wherein for angled pulls, the lateral restraint serves to keep the body in place;

wherein when the actuator is attached to the body by means of the first hook ends of the actuator hooked around the body pin of the body and cylinder pin of the post puller by engagement of the second hook ends of the actuator and the tension member is attached to the chain retainer plate located on the post puller by insertion of the tension member into the chain retaining aperture of the chain retainer plate, as the actuator is extended, the post puller is forced outward, placing the tension member in tension, enabling the pulling of a part off a vehicle on the platform of the vehicle repair apparatus.

* * * * *